United States Patent [19]

Hartmann et al.

[11] Patent Number: 4,881,589

[45] Date of Patent: Nov. 21, 1989

[54] MOLD FOR CONTINUOUS CASTING OF A FLANGED ROLLABLE BILLET FOR A ROLLED GIRDER OR BEAM AND ROLLABLE BILLET MADE THEREWITH

[75] Inventors: Hans-Heinrich Hartmann, Meerbusch; Hans Streubel, Erkrath, both of Fed. Rep. of Germany

[73] Assignee: SMS Schloemann-Siemag Aktiengesellschaft, Dusseldorf, Fed. Rep. of Germany

[21] Appl. No.: 211,757

[22] Filed: Jun. 27, 1988

[30] Foreign Application Priority Data

Jun. 27, 1987 [DE] Fed. Rep. of Germany ..... 3721266

[51] Int. Cl.[4] ..... B22D 11/00

[52] U.S. Cl. ..... 164/491; 164/436

[58] Field of Search ..... 164/436, 491, 476, 477, 164/417, 418

[56] References Cited

U.S. PATENT DOCUMENTS 4,635,702 1/1987 Kolakowski et al. ..... 164/435

FOREIGN PATENT DOCUMENTS 2218408 10/1973 Fed. Rep. of Germany .

60-83743 5/1985 Japan ..... 164/436

*Primary Examiner*—Richard K. Seidel

*Attorney, Agent, or Firm*—Herbert Dubno

[57] ABSTRACT

The mold for continuous casting of a rollable steel flanged billet having a web and two flanges used to make a steel beam or girder comprises two side walls extending over the web and the flanges and two end walls determining the thickness of the flanges positioned movably between the side walls. To provide a continuous casting mold in which the web length, the web thickness and the flange thickness can be independently varied, each of the side walls has a straight portion and an exteriorly directed bent out end portion angled relative to the straight portion, each of the end walls is positioned between a straight portion of one of the side walls and an adjacent opposing bent out end portion of the other of the side walls and at least one side wall is movable in the direction of its planar surface relative to the other side wall transverse to the casting direction. Also at least one side wall is movable in a direction substantially perpendicular to its planar surface to or from the other side wall and transverse to the casting direction. The mold is used to produce a superior quality rollable steel flanged billet which is closer in its dimension to the desired final product in a continuous casting process.

12 Claims, 5 Drawing Sheets

MOLD FOR CONTINUOUS CASTING OF A FLANGED ROLLABLE BILLET FOR A ROLLED GIRDER OR BEAM AND ROLLABLE BILLET MADE THEREWITH

FIELD OF THE INVENTION

Our present invention relates to a mold for continuous casting of a rollable steel flanged billet for a rolled girder or beam (i.e. a steel structural shape). It also relates to a rollable steel flanged billet formed by the mold, and to a continuous casting process for forming this section.

BACKGROUND OF THE INVENTION

A mold for continuous casting of a rollable steel flanged billet (or profile or structural shape) having a web and two flanges for making a steel beam or girder (i.e. a finished structural shape) is known which comprises two cooled side walls extending over the width of the web and the flanges and two end walls determining the thickness of the flanges positioned movably between the cooled side walls.

In a known mold described in German Patent Document No. DE-A1 2 218 408, the steel melt is fed from a tundish through an immersion pouring tube into the region of the web in the mold. To change the flange thickness of the rollable steel flanged billet, the end walls of the cast iron mold are movable between the side walls. A change of the web height and the web thickness is not possible in this known mold. Another disadvantage of this mold is that jamming of the extruded casting can occur as a result of the shrinking of the casting.

OBJECTS OF THE INVENTION

It is an object of our invention to provide an improved mold for the continuous casting of a rollable steel flanged billet for a rolled beam or girder which does not have the abovementioned disadvantages and/or difficulties.

It is also an object of our invention to provide an improved mold for continuous casting with which a rollable section having an adjustable web height, an adjustable web thickness and an adjustable flange thickness can be cast in a simple way.

It is another object of our invention to provide an improved mold for continuous casting with which a rollable section with final dimensions closer to those of the desired finished cast product is produced with a uniformly good quality texture.

It is a further object of our invention to provide an improved rollable steel flanged billet for a rolled beam or girder and an improved continuous casting process for that steel flanged billet using a mold which can be adjusted to produce a variety of different web heights, cross piece thicknesses and flange thicknesses.

SUMMARY OF THE INVENTION

These objects and others which will become more readily apparent hereinafter are attained in accordance with our invention in a mold for continuous casting of a rollable steel flanged billet (i.e. a semifinished shape), having a web and two flanges for making a steel beam or girder or like finished structural shape, the mold comprising two side walls extending over the web and flanges and two end walls determining the thickness of the flanges, the end walls being positioned movably between the cooled side walls.

According to our invention each of the side walls has a straight portion and an exteriorly directed bent out end portion bent from or angled relative to the straight portion. Each of the end walls is positioned between one of the straight portions and an opposing adjacent bent out end portion. At least one side wall is movable in the direction of its planar surface relative to the other of the side walls transverse to the casting direction.

To provide for an adjustable web thickness as well as an adjustable web height at least one side wall is advantageously movable in a direction substantially perpendicular to its planar surface to or from the other side wall and transverse to the casting direction.

The continuous casting mold thus provided can easily and quickly be adjusted to cast beam or girder sections of different web height, web thickness and flange thickness. Thus castings whose dimensions are closer to the final dimensions of a desired end product are made economically in small production quantities. Because of the special configuration of the mold, jamming of the rollable steel flanged billet because of shrinking inside the mold is avoided.

For improvement of the molding conditions for casting rollable steel flanged billets having dimensions close to the final ones, the side walls of the mold can have a widened flared casting region in the region of the web extending only over a portion of the mold height.

In this way, despite a reduced web thickness, the melt is fed through an immersion casting pipe to a location below the bath level and a good distribution is attained of cast metal to the end region.

The flared-end casting region can be curved or arc-shaped and can connect to a lower mold region with a web thickness of from 40 to 90 mm.

The flared-end casting region can extend at least partially into the bent out end portions of the side walls.

The straight portion of a side wall and its adjacent opposing bent out end portion can be oriented at an angle of from 60° to 85° to each other.

The end walls of the mold can be arched interiorly, i.e. they have an interiorly directed projection which extends along the casting direction.

A plurality of supporting rolls corresponding to the web and flanges of the steel flanged billet can be provided underneath the mold to assist its discharge from the mold.

A supporting grate can be provided for the steel flanged billet just below the mold.

In a process for continuous casting of a rollable steel flanged billet with the continuous casting mold according to our invention, the rollable section is advanced below the mold described above in the region of the web and the flange and is hardened. Thereafter the billet is subject to a bending and dressing process. The supporting rolls of the mold and the supporting grate are particularly helpful in performing bending and dressing.

The produced steel flanged billet which is cast by the mold of our invention has a superior quality because there is less shrinkage in the mold and is provided with by a web which has a thickness from 40 to 90 mm and flanges whose legs are oriented at an angle from 60° to 85° to each other. Furthermore the flanges are generally displaced in opposite directions from a neutral axis or the longitudinal axis of the web.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
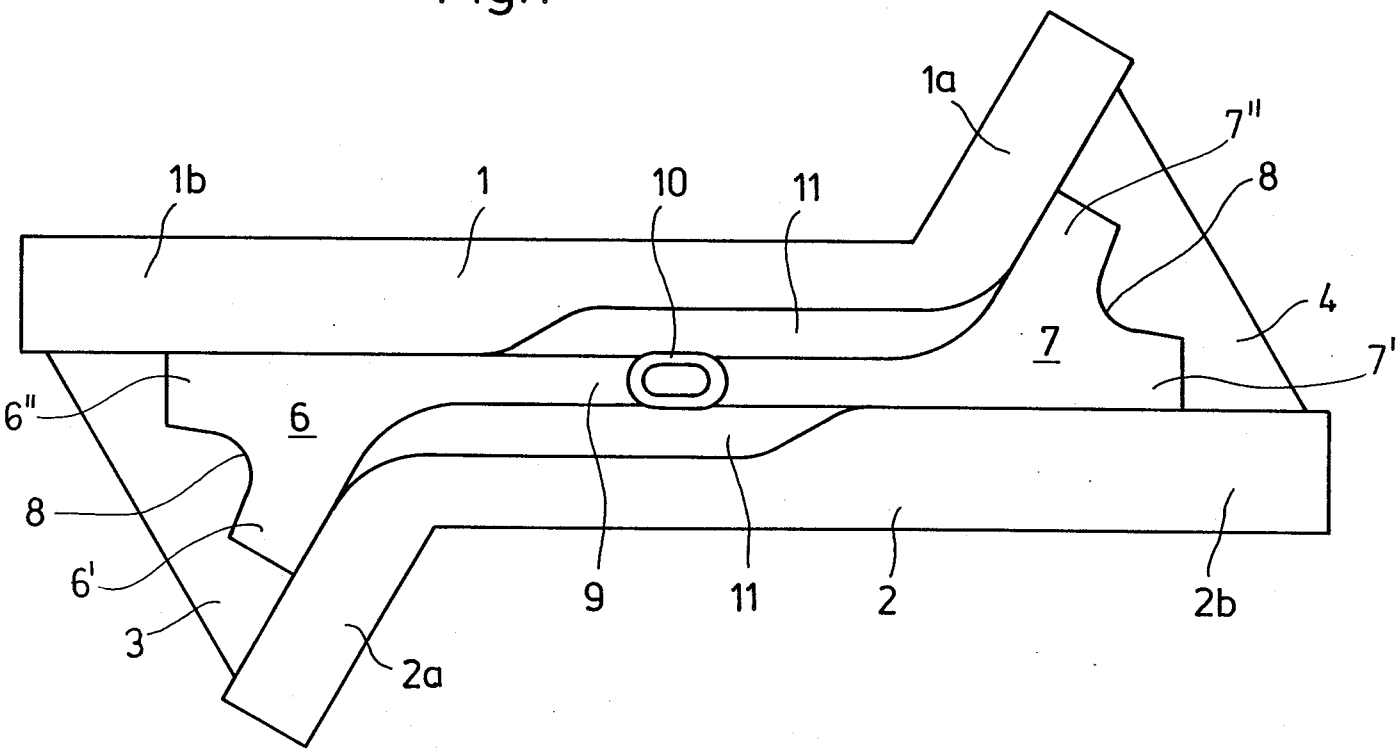
FIG. 1 is a top plan view of a mold for continuous casting of a rollable steel flanged billet.

According to FIGS. 1 to 4, one example of a continuous casting mold according to our invention for casting a rollable steel flanged billet 5 comprises two side walls 1, 2 and two end walls 3, 4 positioned between the side walls 1, 2. The side walls 1, 2 each have a straight portion 1*b*, 2*b* and an exteriorly bent out end portion 2*a*, 1*a*.

The spaces for the flanges 6, 7 of the rollable section 5 are each formed between the straight portion 1*b* or 2*b* of one of the side walls 1 or 2 and the adjacent opposing exteriorly bent out end portion 2*a* or 1*a* of the other side wall 2 or 1. Each end wall 3, 4 is provided with an interiorly directed projection 8 extending in the casting direction so that the flanges 6, 7 are preformed or molded for subsequent rolling.

The central regions of the side walls 1, 2 for molding the web 9 of the rollable section 5 have a widened flared casting region 11 which is curved or arc-shaped and connects to the lower molding or sizing region 12. The casting region 11 ends in the bent out end portions 1*a*, 2*a* of the side walls 1, 2 (FIGS. 1 to 3).

Figure 3:
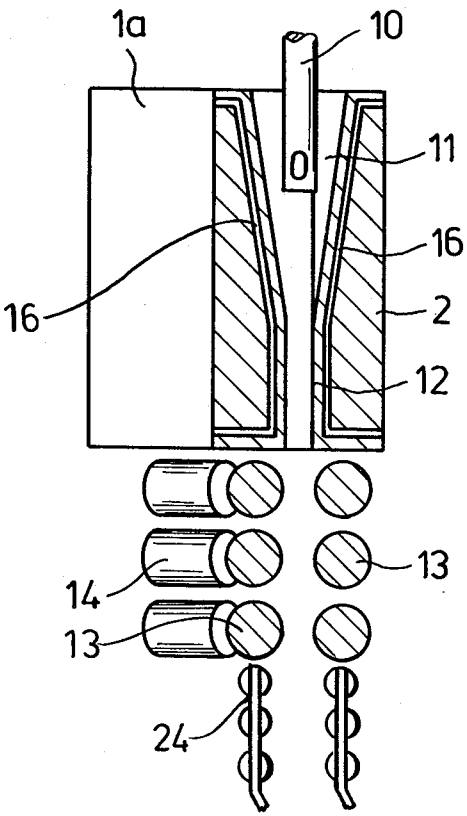
FIG. 3 is a cross sectional view of the mold of FIG. 2 taken along the section line III—III of FIG. 2.
Figure 2:
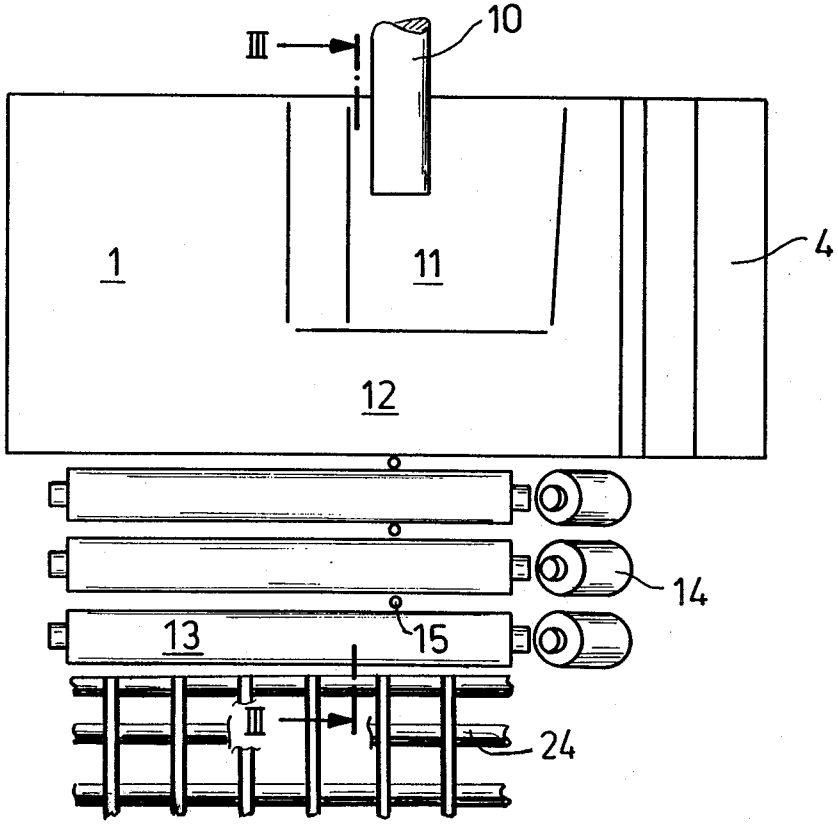
FIG. 2 is an interior side elevational view of a side wall of the mold of FIG. 1 with an end wall present.
Figure 4:
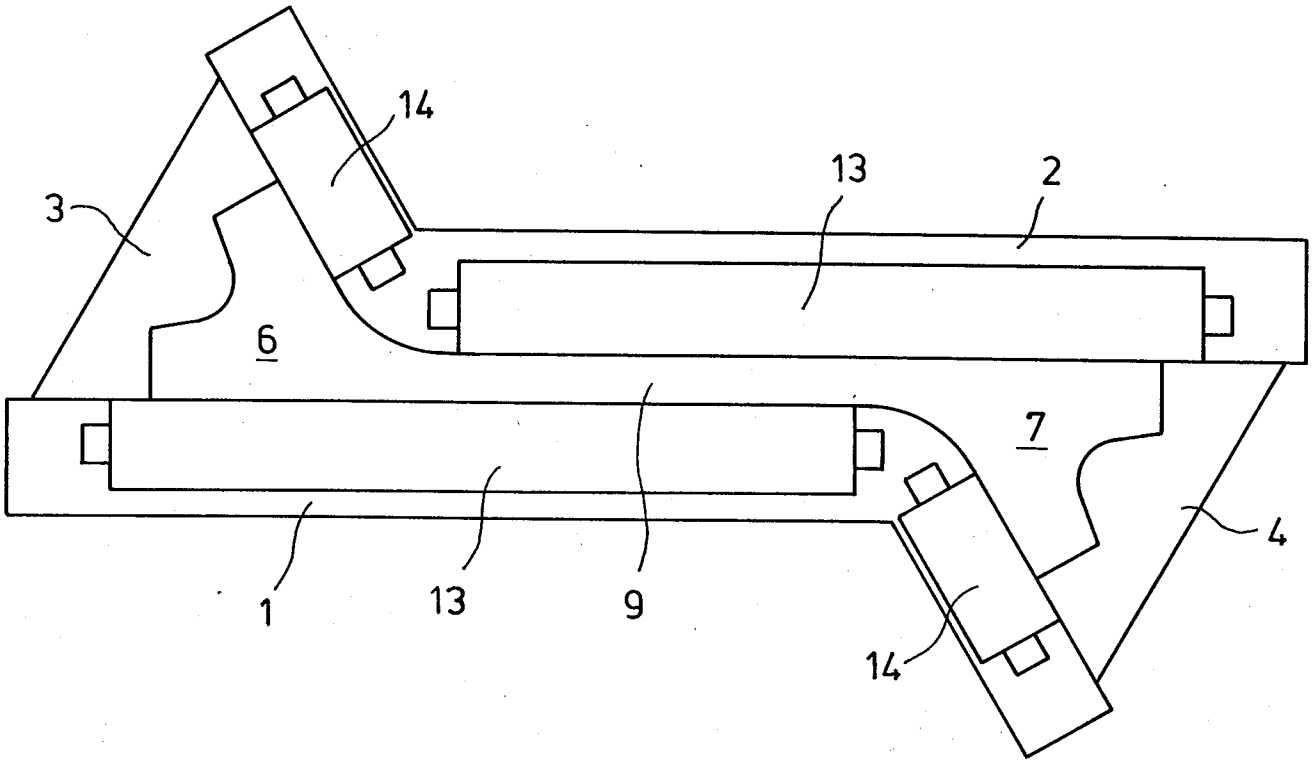
FIG. 4 is a bottom plan view of the mold of FIG. 1 with supporting rolls.
Figure 5:
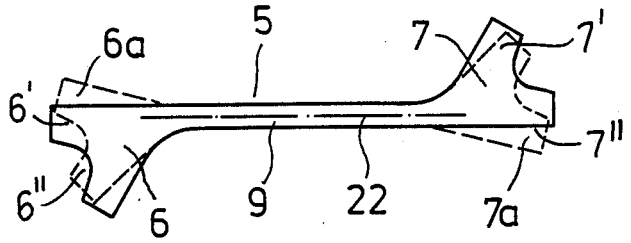
FIG. 5 is a top plan view of the rollable section formed by the continuous casting.

As can be seen from FIGS. 2, 3 and 4, several supporting rolls 13, 14 follow directly after the mold in the casting direction. Their positioning corresponds to the shape and dimensions of the web 9 and the flanges 6, 7 of the rollable steel flanged billet 5 as is especially apparent from FIG. 4. Water spray nozzles 15 for cooling the casting are located between the supporting rolls 13 or 14.

According to FIG. 3 the side walls 1, 2 and the end walls 3, 4 of the mold are provided with cooling ducts 16.

Figure 6:
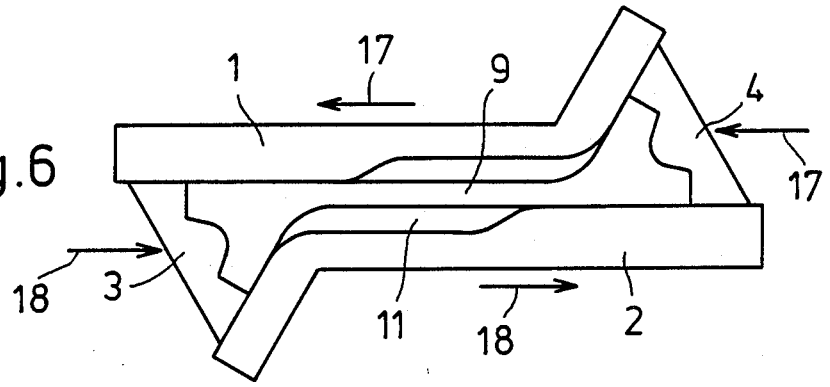
FIGS. 6, 7 and 8 are top plan views of the mold according to our invention set in different configurations.
Figure 7:
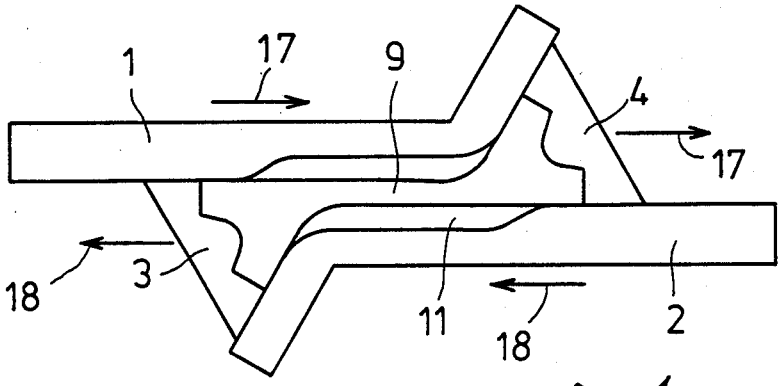

In FIGS. 6 and 7 it is shown that the side walls 1, 2 of the mold are movable parallel to each other transverse to the casting direction in the direction of the arrows 17, 18. In this way the length of the web 9 of the rollable steel flanged billet 5 can be changed.

Figure 8:
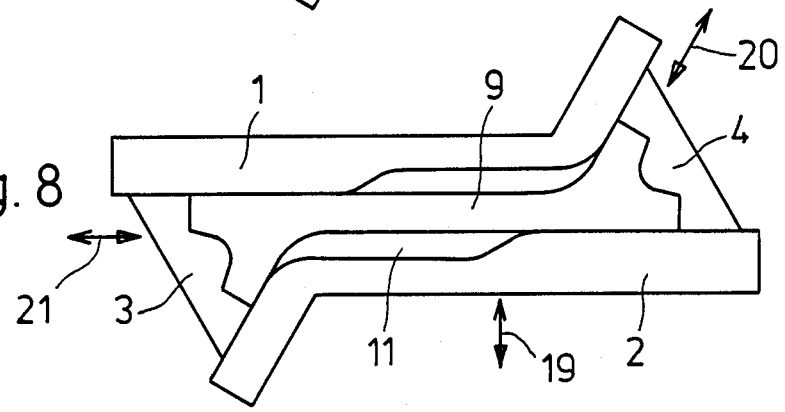
Figure 9:
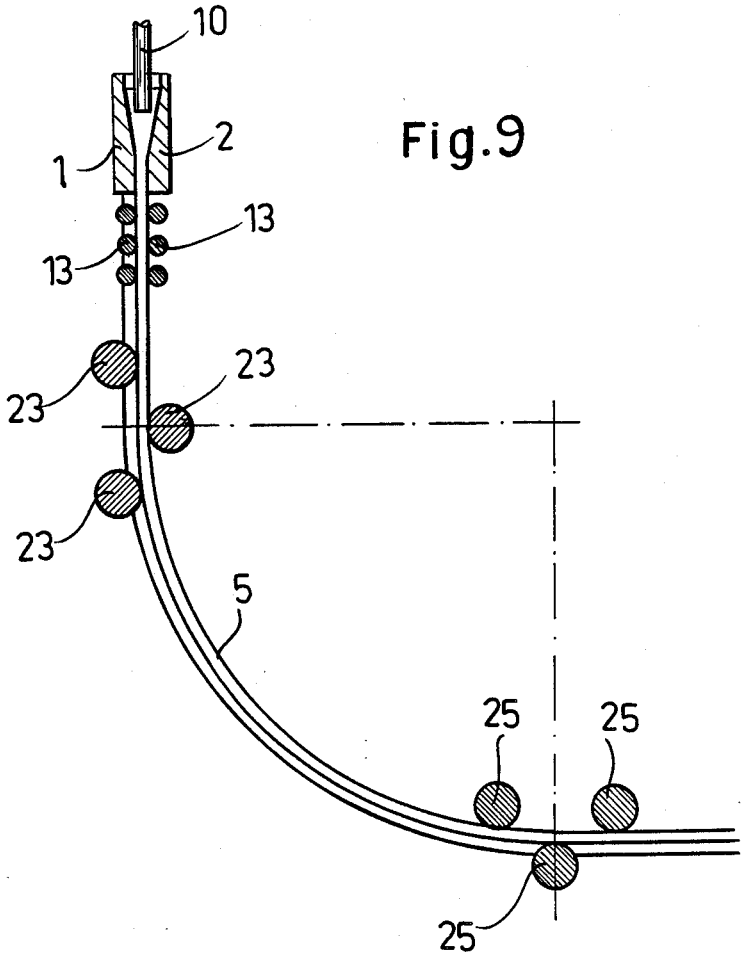
FIG. 9 is a cross sectional view similar to FIG. 3 but further detailing downstream bending means.

A change of thickness of the web 9 in contrast to the adjustment shown in FIG. 6 is indicated in FIG. 8. The side wall 2 of the mold is moved or shifted in the direction of the arrow 19 (also transverse to the casting direction) and the end walls 3, 4 are moved or shifted accordingly in the direction of the arrows 20, 21.

In the casting process, the cast rollable section 5 is guided along a curved path from a vertical into a horizontal orientation and is then directed along a straight path again. After hardening a bending and dressing process can be performed. The flanges 6, 7 initially unsymmetrically oriented with respect to the axis of symmetry 22 of the web 9 are displaced in the direction of the neutral axis 22 and thus into the position 6*a*, 7*a* respectively. This action simplifies the following rolling process.

A supporting grate 24 can be provided following the supporting rolls 13, 14 to guide the steel flanged billet 5 issuing from beneath the mold. Bending rolls 23 followed by directing rolls 25 can be provided downstream from the supporting rolls.

Our invention is not limited to the above illustrated example.

The mold described above produces a rollable steel flanged billet which has dimensions closer to those of the desired final product than the mold which has been previously used. This rollable steel flanged billet has a web thickness of from 40 to 90 mm and the legs 6', 6'' and 7', 7'' of the flanges 6, 7 are oriented at an angle of 60° to 85° with respect to each other. When the rollable steel flanged billet issues from the mold, the flanges 6, 7 are displaced in opposite directions from the neutral axis or central longitudinal axis 22 of the web 9. This means essentially that a line bisecting the legs 6', 6'' of the flange 6 is directed on one side of the neutral axis 22 while the line bisecting the legs 7', 7'' of the flange 7 points in an opposite direction on the opposite side of the symmetry line 22. This product steel flanged billet has a superior texture because shrinkage is less likely in the mold.

We claim:

1. In a mold for continuous casting of a rollable steel flanged billet comprising a web and two flanges for making a steel beam or girder comprising two side walls extending over said web and said flanges and two end walls determining the thickness of said flanges positioned movably between said side walls, the improvement wherein each of said side walls has a single straight portion and a single bent out end portion directed exteriorly bent from said straight portion, each of said end walls is positioned between one of said straight portions and an adjacent opposing one of said bent out end portions and at least one of said side walls is movable in the direction of a planar surface of said side wall relative to the other of said side walls transverse to the casting direction.

2. The improvement defined in claim 1 wherein at least one of said side walls is movable in a direction substantially perpendicular to said planar surface to or from the other of said side walls and transverse to said casting direction to adjust the thickness of said web.

3. The improvement defined in claim 1 wherein said side walls have a flared casting region widening only over a limited portion of the mold height for receipt of an immersion pouring tube.

4. The improvement defined in claim 1 wherein said mold has a flared casting region that is curved or arc-shaped and connects to a lower molding region with a web thickness of from 40 to 90 mm.

5. The improvement defined in claim 1 wherein said mold has a flared casting region that at least partially extends into said bent out portions of said side walls.

6. The improvement defined in claim 1 wherein said one of said straight portions and said adjacent one of said bent out end portions are oriented at an angle of from 60° to 85° to each other.

7. The improvement defined in claim 1 wherein said end walls have a central projection extending in said casting direction.

8. The improvement defined in claim 1 wherein a supporting grate suitable for the path of said web and said flanges is provided underneath said mold.

9. The improvement defined in claim 1 wherein a plurality of supporting rolls corresponding to said web and said flanges are provided on the underside of said mold.

10. A mold for continuous casting of a rollable steel flanged billet comprising a web and two flanges for making a steel beam or girder comprising:

two side walls extending over said web and said flanges each having a straight portion and a bent out end portion exteriorly directed oriented at an angle of from 60° to 85° to said straight portion, said side walls being oriented so that said straight portion of one of said side walls is positioned opposite and adjacent to said bent out end portion of the other one of said side walls, at least one of said side walls being movable in the direction of a planar surface of said side wall relative to the other of said side walls and transverse to the casting direction, said side walls having a flared casting region widening only over a limited portion of the height of said mold for receipt of an immersion pouring tube, said flared casting region at least partially extending into said bent out end portions of said side walls, and two end walls determining the thickness of said flanges each of which is positioned movably between one of said straight portions of one of said side walls and an adjacent opposing one of said bent out end portions of the other of said side walls, said end walls each having a central inwardly directed projection extending along said casting direction.

11. A mold as defined in claim 10 wherein at least one of said side walls is movable in a direction substantially perpendicular to said planar surface to or from the other of said side walls and transverse to said casting direction to adjust the thickness of said web.

12. A process for continuous casting of a rollable steel flanged billet having a web and two flanges using a continuous casting mold comprising two side walls extending over said web and said flanges and two end walls determining the thickness of said flanges each of which is positioned movably between said side walls, each of said side walls having a straight and a bent out end portion angled relative to said straight region, said end walls being positioned between adjacent opposing ones of said straight and said bent out end regions, at least one of said side walls being movable in the direction of a planar surface of said side wall relative to the other of said side walls transverse to the casting direction and also being movable in a direction substantially perpendicular to said planar surface comprising:

(a) moving said one side wall in a direction along said planar surface to set a web length of said rollable steel flanged billet;

(b) moving said one side wall perpendicular to said planar surface to set the web thickness of said rollable steel flanged billet;

(c) hardening said rollable steel flanged billet and guiding said rollable steel flanged billet below said mold;

(d) bending said rollable steel flanged billet; and (e) dressing said rollable steel flanged billet.

* * * * *